US005961025A

United States Patent [19]

Fukumoto et al.

[11] Patent Number: 5,961,025

[45] Date of Patent: Oct. 5, 1999

[54] ULTRASONIC WAVE SPLICING DEVICE

[75] Inventors: Sachio Fukumoto; Naohiro Yamamoto; Syuichi Nakajima; Toshio Hirayama, all of Hino, Japan

[73] Assignee: Konica Corporation, Japan

[21] Appl. No.: 08/928,088

[22] Filed: Sep. 12, 1997

[30] Foreign Application Priority Data

Sep. 17, 1996 [JP] Japan ..... 8-244925
May 8, 1997 [JP] Japan ..... 9-118063

[51] Int. Cl.[6] ..... B65H 21/00

[52] U.S. Cl. ..... 228/5.7; 228/13; 156/304.5; 156/157

[58] Field of Search ..... 228/5.7, 13, 171; 430/56, 127; 156/304.1, 304.5, 157–159, 580.1

[56] References Cited

U.S. PATENT DOCUMENTS 4,247,209 1/1981 Carlson et al. ..... 156/502
4,968,369 11/1990 Darcy et al. ..... 156/580.1
5,679,207 10/1997 Palone et al. ..... 156/580.1

*Primary Examiner*—Samuel M. Heinrich
*Attorney, Agent, or Firm*—Jordan B. Bierman; Bierman, Muserlian and Lucas

[57] ABSTRACT

An apparatus for splicing a trailing edge of a first web currently used for a web product with a leading edge of a second web to be used after the first web, comprises a cutting device for cutting the first and second web simultaneously on the superimposed condition so as to form a trailing edge of the first web and a leading edge of the second web, an overlapping device for overlapping the leading edge of the second web on or beneath the trailing edge of the first web so as to form a overlapped section with a predetermined overlapped width; and a ultrasonic welder for welding the overlapped section so as to form a joint section at which the trailing edge of the first web is spliced with the leading edge of the second web.

14 Claims, 18 Drawing Sheets

FIG. 8 ( a )
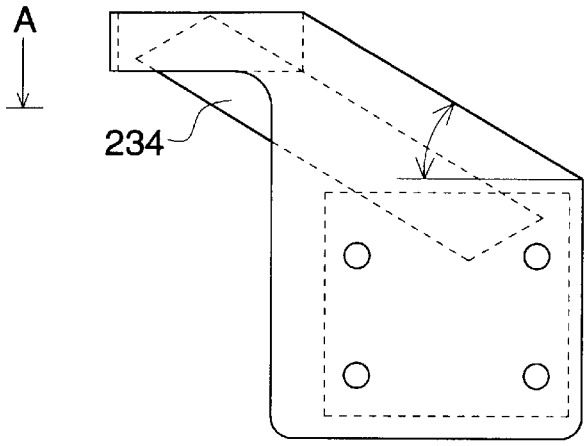
FIG. 8 ( b )
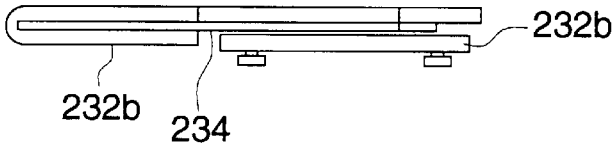
FIG. 8 ( c )
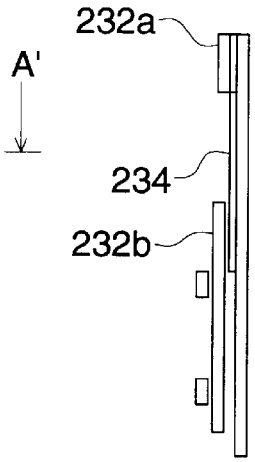
FIG. 8 ( d )
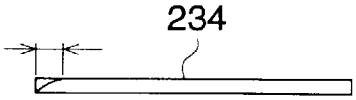

ULTRASONIC WAVE SPLICING DEVICE

BACKGROUND OF THE INVENTION

The present invention relates to a coating and drying device which coats light-sensitive layers on a roll-wound long roll sheet material (hereinafter, referred to as a web) and dries it to manufacture a light-sensitive film, and an ultrasonic wave welding device and splice sensing device which senses splices of aforesaid web.

In continuous production of a light-sensitive film, a web wound on a supply roll on an unwinding device is continuously unwound for production. When one web is totally unwound due to the passage of time, a the leading end of web used for the next production is spliced to the previous web. Incidentally, the roll currently unwinding is referred to as the first supply roll, and the roll used for the next production is referred to as the second supply roll. Webs wound from the first roll and the second roll are respectively referred to as the first web and the second web.

FIG. 18 is a schematic drawing showing a conventional splice sensing method. FIG. 19 is a schematic drawing showing a conventional joining method. In conventional splicing, as shown in FIG. 19, the first web and the second web are cut with an automatic splicer, and then, a wide silver-colored tape strip is sealed in front of and behind the web joint. Aforesaid silver tape portions are, as shown in FIG. 18, sensed as a pulse signal by an electrostatic volume sensor and a converter to control tracking.

However, aforesaid silver tape portion (see FIG. 19) induces air-drag, solution splashing due to the difference of coating effectiveness on the silver tape and on the web and meandering of the web due to less than perfect parallelness. In addition, process contamination due to the adhesive agent of the metallic silver tape also occurs. Due to the occurrence of uneven coating and uneven undrying as a result of the aforesaid issues, acceptable coating is impossible so that much product loss occurs.

In order to overcome aforesaid solution splashing and meandering due to lack of parallelity, it is necessary to smooth the transition of the trailing end of the first web and the leading end of the second web and to minimize the amount of overlap of the first web and the second web. In addition, it is also necessary to weld webs while keeping the welding load constant to assure smoothly joined webs.

SUMMARY OF THE INVENTION

Considering the above-mentioned technical problems, a first object of the present invention is to provide an ultrasonic wave welding device which forms smooth splices in the web.

Considering the above-mentioned technical problems, a second object of the present invention is to provide a coating and drying device which prevents product loss due to non-uniform coating and uneven undrying due to aforesaid uneven coating.

Considering the above-mentioned technical problems, a third object of the present invention is to provide a splice sensing device which can sense a spliced section produced by ultrasonic wave welding accurately.

The above-mentioned objects are attained by the following constitutions:

(1) An ultrasonic wave welding device which joins a second web to a first web continuously conveyed, comprising a first suction box and a second suction box which respectively draw onto themselves the above-mentioned first web and the second web, and synchronously move with them, a fixing device which assures a parallel relationship between the above-mentioned first web and the second web, a double-layer cutting device which cuts the above-mentioned first web and the above-mentioned second web while they are over-lapped, a device which overlaps the above-mentioned first web and the above-mentioned second web in a prescribed amount, a splicing device which welds and splices an overlapped portion by the above-mentioned lapping device with a ultrasonic wave energy and an edge cutting device which trims the edge portion across the width direction of the spliced portion welded by aforesaid splicing device.

(2) A coating and drying device, wherein an ultrasonic wave welding device which welds the trailer end of the first web and the leading end of the second web, an edge cutting device which forms an edge-cutting section by cutting the edge portion across the width direction of the spliced portion welded and a splicing portion sensing unit which senses a spliced portion from the above-mentioned edge cut.

(3) A spliced portion sensing device which senses splicing of the second web and the first web from the edge cut section formed by cutting the edge portion across the width direction of the spliced portion, incorporating an ultrasonic wave sensor, an edge control section which controls the edge position of the above-mentioned both webs, a pulse generation circuit which generates splicing pulse based on the sensing signal of the above-mentioned ultrasonic wave sensor and a retarder which retards aforesaid splicing pulse are provided and hunting of the sensing signal due to the fluttering of the web can be controlled by adjusting the interval of the web conveyance rollers brought into contact with the upstream and downstream of the above-mentioned ultrasonic wave sensor and/or adjusting of sending and receiving light angle of the above-mentioned ultrasonic wave sensor.

BRIEF DESCRIPTION OF THE DRAWINGS

FIGS. 8(*a*) to 8(*d*) are drawings showing the retention member of the cutter blade of the present embodiment.

DETAILED DESCRIPTION OF THE PREFERRED EMBODIMENT

Figure 1:
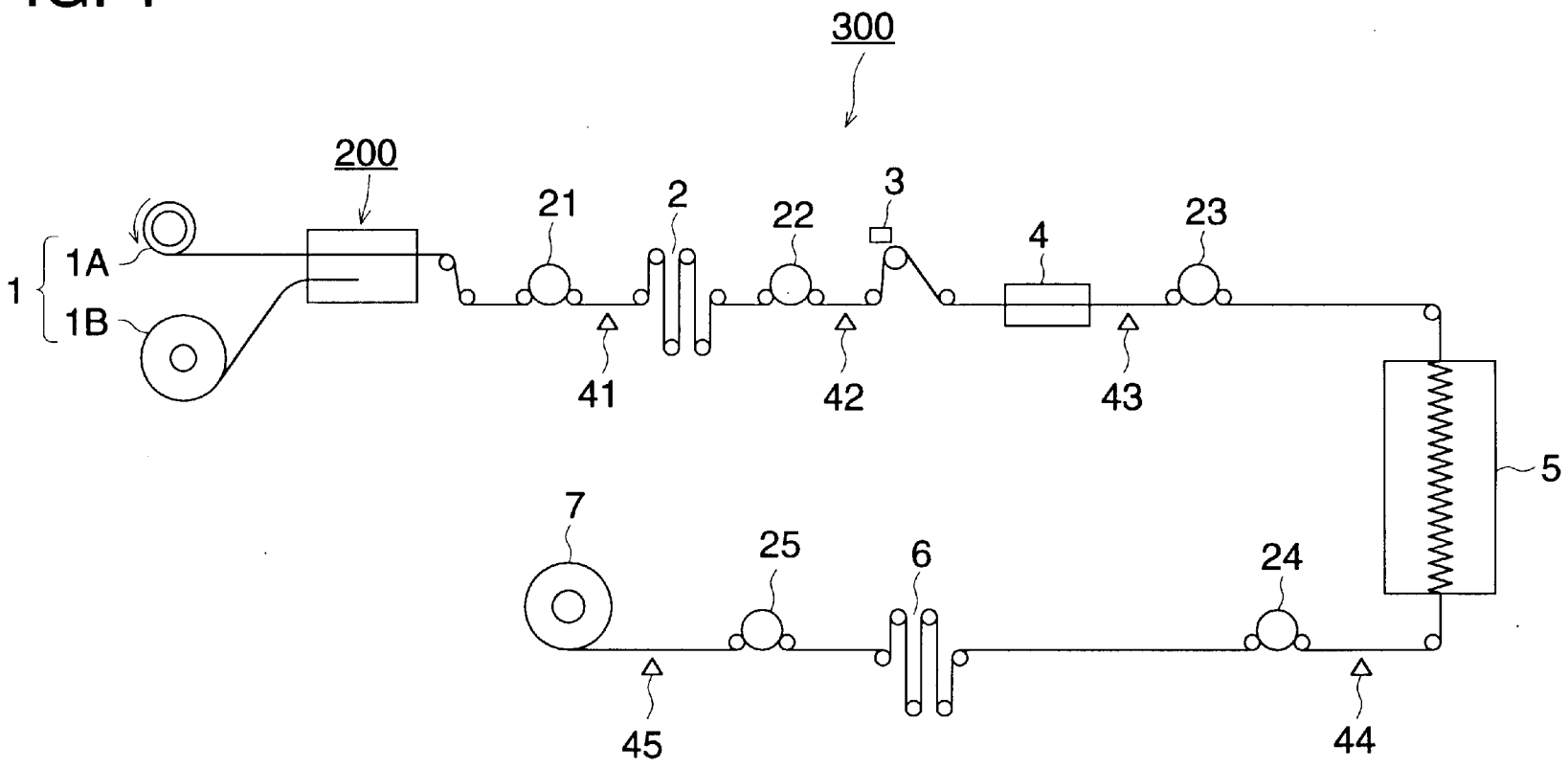
FIG. 1 is a block diagram showing coating and drying devices of the present embodiment.

FIG. 1 is a block diagram showing a coating device and a drying device of the present embodiment.

Aforesaid coating and drying devices coat light-sensitive layers on a long sheet material (hereinafter, re-defined as a web) wound in a roll state, and dries it to form a light-sensitive film, in which unwired 1 whites composed of first supply roller 1A and second supply roller 1B, ultrasonic splicer 200 which subjects the trail end of the first web and the leading end of the second web to ultrasonic waves, first accumulator 2, coating section 3 which coats emulsions on aforesaid uncoated web surface, setting section 4 wherein a coated web is cooled for hardening aforesaid light-sensitive layers, drier 5 which dries the coated web, second accumulator 6 and winder 7 which has a winding roll which winds the coated web which is a light-sensitive film which has been coated and dryed. Aforesaid coating and drying devices are provided with feeding rollers 21 through 25 and overlap sensing units 41 through 45.

Figure 2:
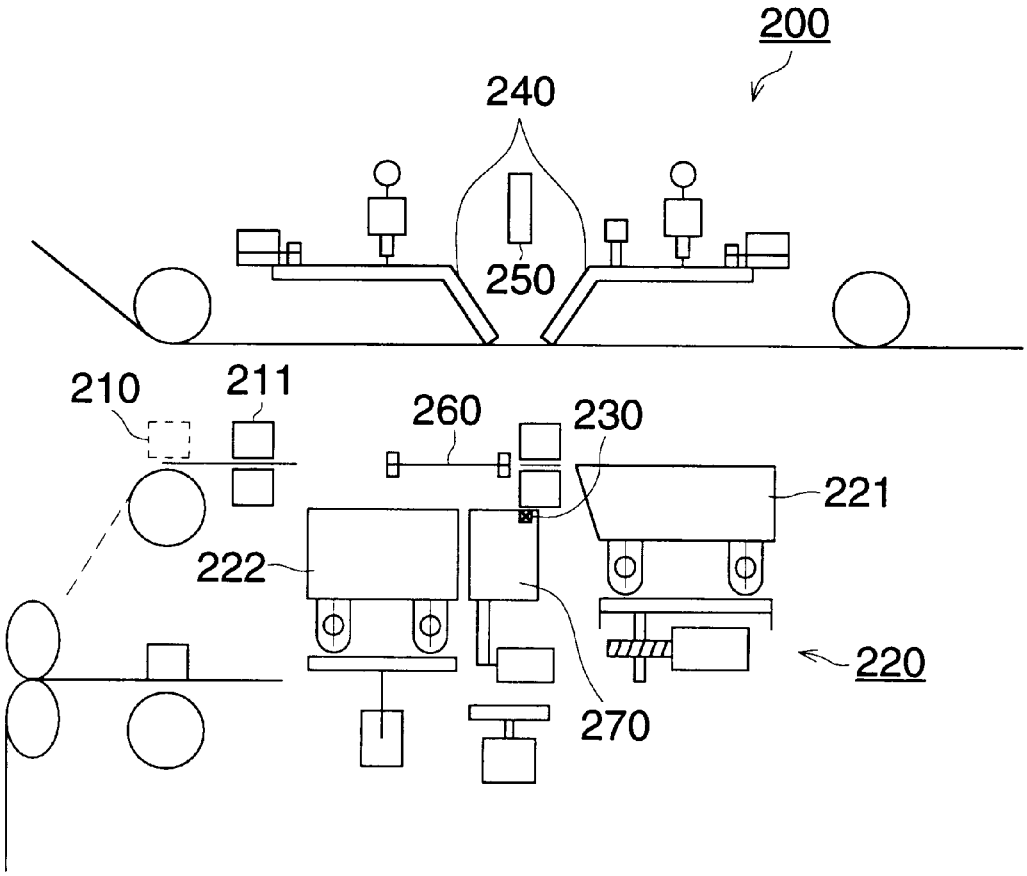
FIG. 2 is a schematic block diagram of an ultrasonic wave splicer which is an embodiment of the ultrasonic wave welding device of the present invention.

FIG. 2 is a schematic block diagram of a ultrasonic splicer of the present invention of an ultrasonic subjecting device.

Ultrasonic splicer 200 is an ultrasonic subjecting device, composed of second web conveying device 210, overlapping device 220, double-layer cutting device 230, fixing device 240, ultrasonic horn unit 250 and edge cutting device 260.

Their characteristics structures and functions of each section will, hereinafter, be explained referring to FIGS. 3 through 11 and FIG. 2.

Second conveyance device 210 is composed of clamp 211 which clamps the front edge of the second web, actuator which moves clamp 211 and a movement device which moves the web which was clamped by clamp 211 up toprocessing stand 270 through second suction box 221.

The conveyed second web is absorbed to second suction box 221.

Figure 3:
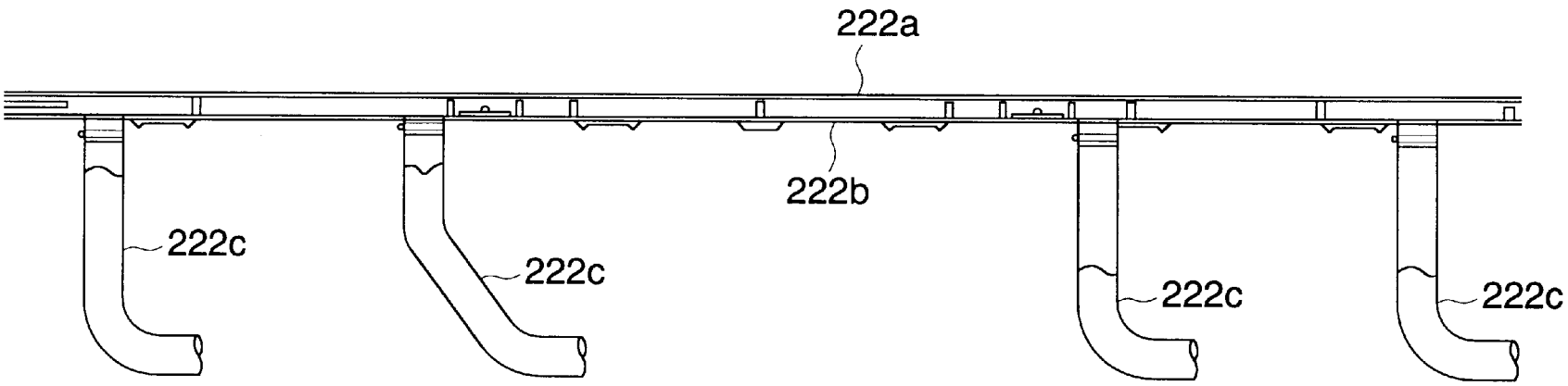
FIG. 3 is a side cross sectional view of a drawing mechanism of second web suction box 221.
Figure 4:
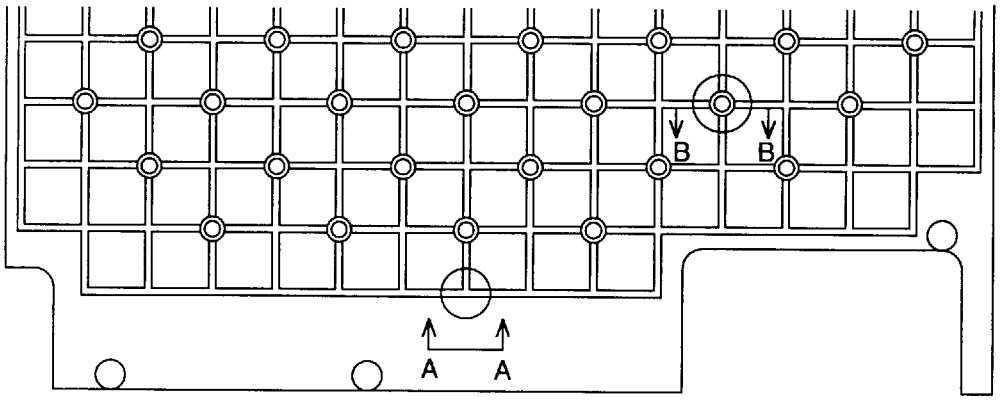
FIGS. 4(*a*) to 4(*c*) are views showing loading stand 222*a* of second web suction box 222.
Figure 4:
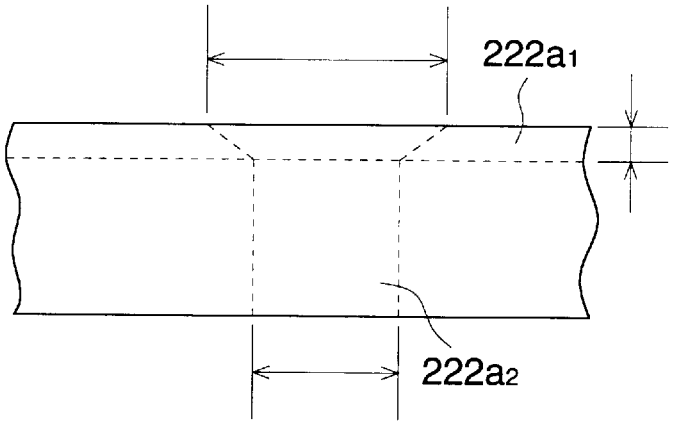
Figure 4:
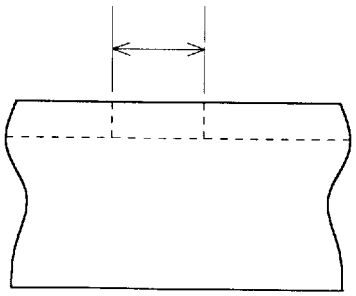

Since the suction mechanism and its loading plate of second web suction box 221 are identical to those of first web suction box, the suction mechanism and its loading plate of second web suction box 221 are explained referring to FIGS. 3 and 4.

FIG. 3 shows a cross sectional side view of the suction mechanism of second web suction box 222. FIG. 4 is a drawing showing loading plate 222*a* of second web suction box 222. FIG. 4(*a*) is a plane view of loading plate 222*a*. FIG. 4(*b*) is a cross sectional view at B—B of FIG. 4(*a*). FIG. 4(*c*) is a cross sectional view of A—A of aforesaid loading plate 222*a* shown by FIG. 4(*a*).

As shown in FIGS. 4(*a*) and 4(*c*), loading plate 222*a*forms grid-shaped groove $\mathbf{222}a_1$. Every other one of the crossing points of aforesaid groove $\mathbf{222}a_1$, holes for suction $\mathbf{222}a_2$, as shown in FIG. 4(*b*), are formed.

Second web suction box 222 forms a tightly closed box together with bottom plate 222*b* and a side plate (see FIG. 3), in which loading plate 222*a* faces the upper surface. Bottom plate 222*b* is connected with a suction pipe 222*c*. To suction pipe 222*c*, evacuation blowers (not illustrated) are connected. When evacuation is conducted by aforesaid evacuation blower while a second web is placed on loading plate 222*a*, aforesaid second web is suctioned onto loading plate 222*a*. Accordingly, second web suction box 222 of the present embodiment, suctions the second web without creating wrinckles and aforesaid web is then conveyed to processing stand 270.

After clamping both end in the width direction of the first web to reduce curling of the first web, fixing device 240 (shown in FIG. 2) senses two points at the side of the first web by the laser sensor. In the same manner, fixing device 240 senses two points at the side of the second web absorbed on second suction box 222 to be fixed by the laser sensor. By comparing and calculating aforesaid positional data, accurate positioning of the first web and the second web is calculated. From the conveyance position of the first web, appropriate standard position is determined. By modifying the position of the second web by moving second suction box 222 due to calculating positional correction amount for modifying deviation and parallelty of the second web, aligning between the first web and the second web is conducted. After aligning, fixing device 240 pushes down the first web so that the first web and the second web are accurately overlapped on the cutting section 230 on processing stand 270.

Double-layer cutting device 230 is composed of cutting section 230 provided on processing stand 270 and cutting member 233 which cut the over-lapped webs while lapping the first web and the second web on aforesaid cutting section.

The constitution and functions of cutting member 233 will now be explained referring to FIGS. 7 and 8.

Figure 7:
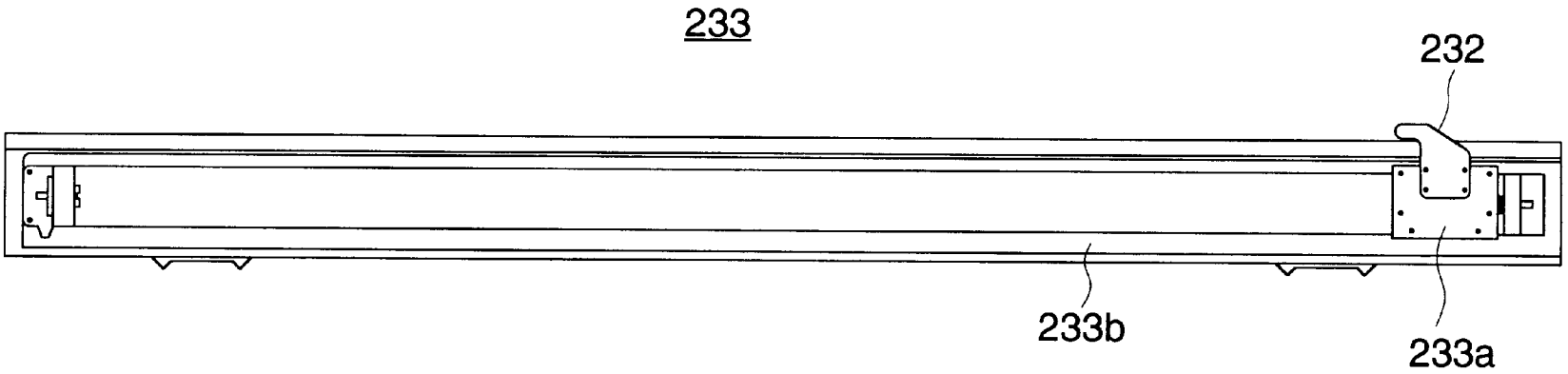
FIG. 7 is a side view of a cutting member of the present embodiment.

FIG. 7 is a side view of a cutting member of the present embodiment.

Cutting member 233 is composed of, as shown in FIG. 8, retention member 232 which retains cutter knife 234, movable section 233*a* which moves while fixing retention member 232, guide member 233*b* which guides the movement of movable section 233*a* and an air-type actuator (not illustrated) which drives movable section 233*a*. Aforesaid cutting member 233 is loaded on cutting section on processing stand 270 to be fixed. Incidentally, cutting section on processing stand 270 is inclined from one side to the other side. Due to this inclination, if movable section 233*a* moves on guide member 233*b*, it moves while dropping. Aforesaid amount of drop is several mm between one side and the other side.

FIG. 8 is a drawing showing a retention member of the cutter knife of the present embodiment. FIG. 8(*a*) shows a front view of the retention member. FIG. 8(*b*) is a plan view of the retention member. FIG. 8(*c*) shows a side view of the retention member. FIG. 8(*d*) is an edge view of A—A.

Retention member 232 is a member to retain cutter blade 234 in such a manner that aforesaid cutter blade has an inclination of about 30°, by having folding section 232*a* sandwich one end of cutter blade 234 and fixing with screws the other end of cutter blade 234 onto of plate member 232*b*.

The shape of the blade can be seen in FIG. 8(*d*). As described above, retention member 232 is fixed to movable section 233*a*.

Due to being provided with the above-mentioned constitution, double-layer cutting device 230 superposes and fixes the first web and the second web onto cutting section on processing stand 270 by means of fixing device 240. By means of the air-type actuator, cutter blade 234 is installed onto movable section 233*a* at an appropriate angle, for example, about 30°. Due to this angle, from one side to the other side, cutter blade 234 cut the over-lapped first web and the second web. Simultaneously with the completion of aforesaid cutting, fixing between the first web and the second web is released. Due to this, double-layer cutting device 230 of the present embodiment produces an identical cut surface of the trailing end of the first web and that of the leading end of the second web. It is preferable that the cutting surface is vertical to the plane of web.

The trailing end of the first web and the leading end of the second web whose cutting surfaces has become identical by means of double-cutting device is overlapped on the welding section on processing stand 270 by means of overlapping device 220.

Overlapping device 220 is composed of, as shown in FIG. 2, second web suction box 221, first web suction box 222 and pushing up mechanism. For example, after lowering second web suction box 221 by 50 mm, first web suction box 222 is moved toward the side of second web suction box 221. By floating up second web suction box 221 again, the first web and the second web are overlapped with several mm.

Figure 5:
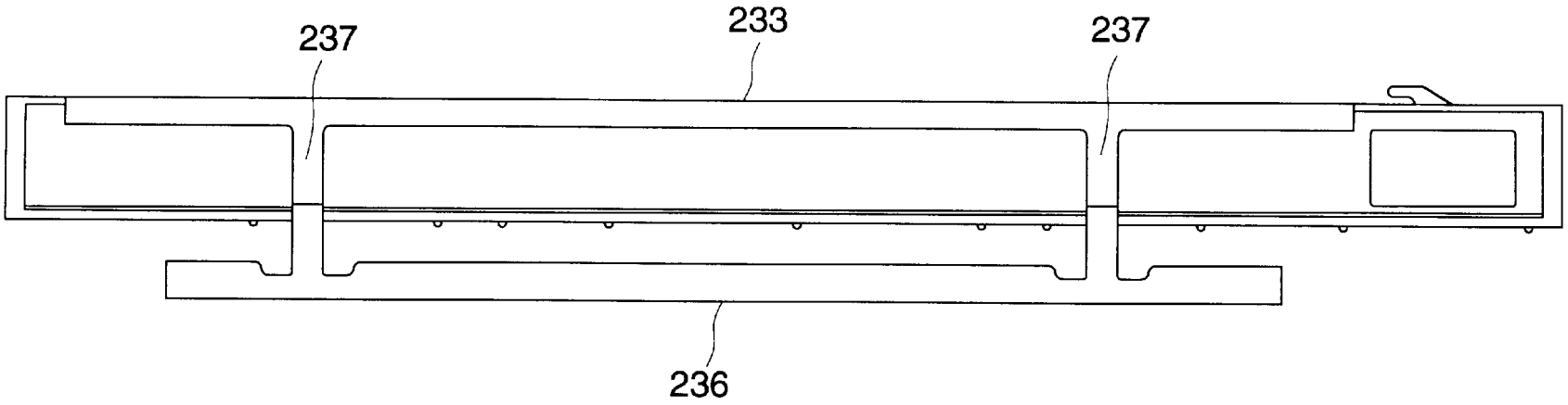
FIG. 5 shows a side drawing of a pushing-up mechanism of the present embodiment.

FIG. 5 shows a side view of a pushing-up mechanism of the present embodiment.

The function of pushing-up member 236 is to set the trailing end of the first web below the leading end of the second web when the trailing end of the first web and the leading end of the second web are over-lapped onthe welding section of the processing stand 270. The purpose of pushing-up member 236 is that, since curling occurs at the trailing end of the first web because the first web is wound on unwinder 1 (see FIG. 1) on the supply roll 1A in a roll state, pushing-up between the leading end of the second web and the trailing end of the first web become unstable when the first web and the second web are over-lapped on the welding section of processing stand 270 so that it is preferable for the leading end of the second web to lap on the trailing end of the first web. Here, the outline of the driving mechanism of pushing-up member 236 will be explained.

As shown in FIG. 5, at the side surface of cutting member 233, guide notch 237 is formed in such a manner that pushing-up member 236 oscillates aforesaid guide notch 237. Aforesaid pushing-up member 236 is actuated by an air-type actuator (not illustrated).

Figure 6:
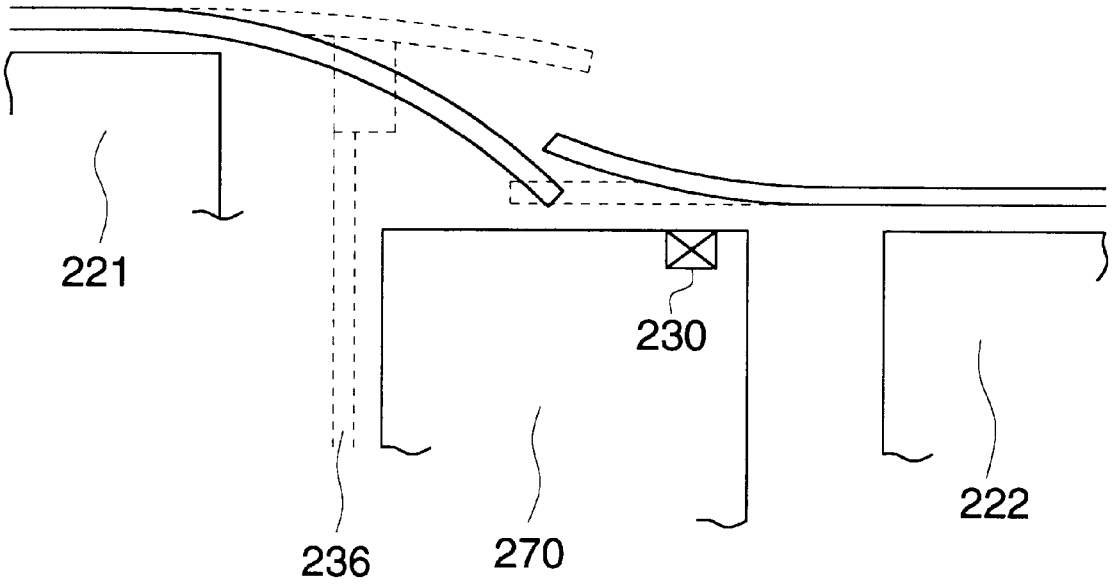
FIG. 6 is an illustration showing the movement of the pushing-up member.

Here, referring to FIG. 6, pushing-up operation will now be explained. FIG. 6 is an illustration showing operation of the pushing-up member shown in FIG. 5.

FIG. 6 shows the state immediately before the traling end of the first web and the leading end second web represented by continuous lines are overlapped on processing stand 270. Since the first web which is drawn to first web suction box 222 was tightly wound on a supply roll 1A in a roll state on unwinder 1 (see FIG. 1), curling occurs at the trailing end of the web. Accordingly, the leading end of the second web conveyed while being drawn to the second web suction box 222 is over-lapped on the trailing end of the first web. If these webs are adhered to each other in this over-lapping state, it will result in uneven coating and uneven drying in the coating step and the drying step later.

In the present embodiment, pushing-up member 236 is actuated to force the trailing end of the first web drawn to first web suction box 221, as shown by a dashed line in FIG. 6. Under this condition, the front end of the second web drawn onto second web suction box 222 surely invades into the below the first web, as shown by a dashed line in FIG. 6.

The trailing end of the first web and the leading end of the second web, which are overlapped with several mm with at the welding section of processing stand 270 by means of overlapping device 220 is welded to be spliced by horn unit 250.

The constitution and the functions of horn unit 250 will now be explained referring to FIGS. 9 through 11.

Figure 9:
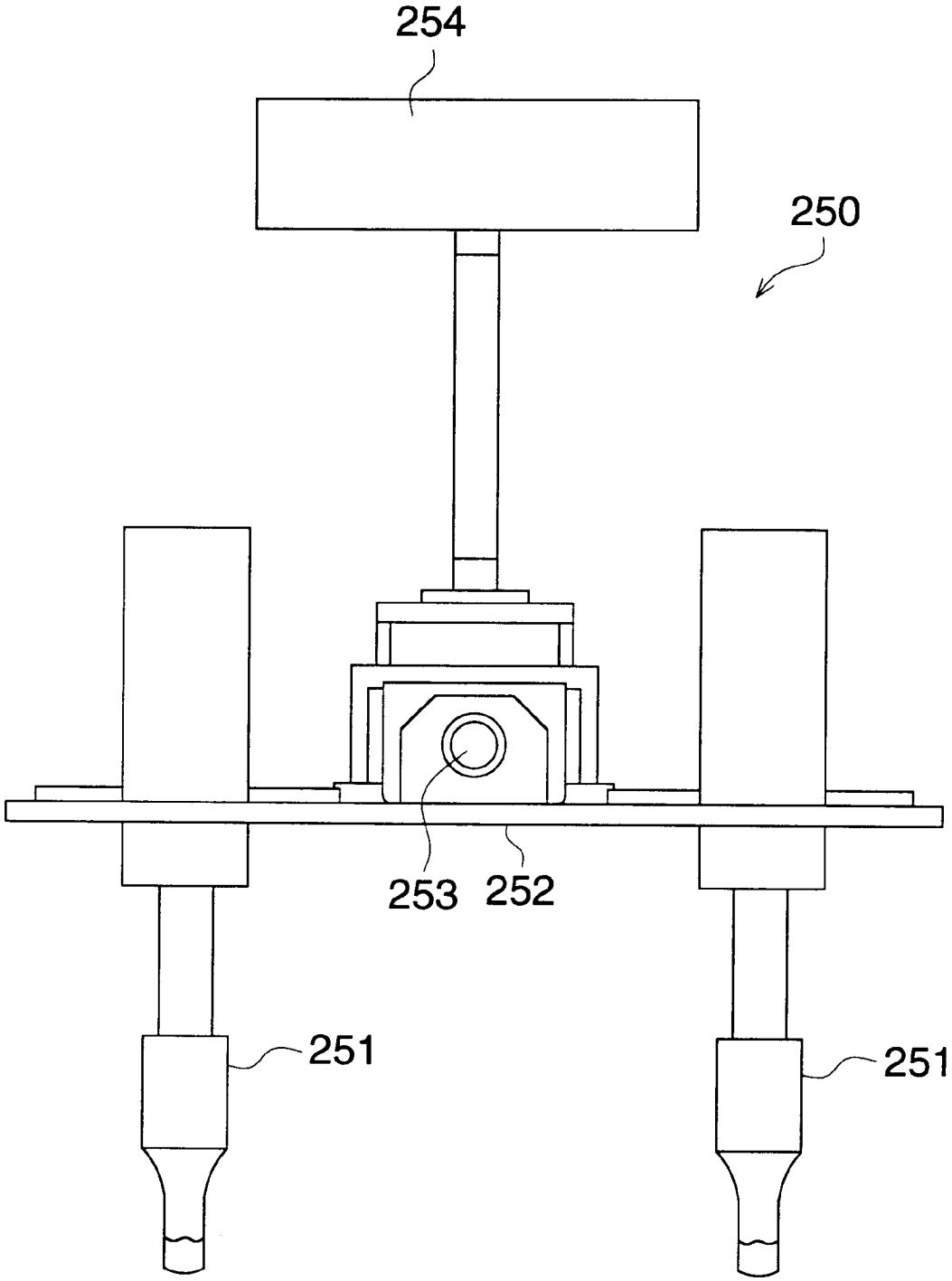
FIG. 9 is a side view of a horn unit.

FIG. 9 is a side view of the horn unit. FIG. 10 is a plan view of the horn unit.

Figure 10:
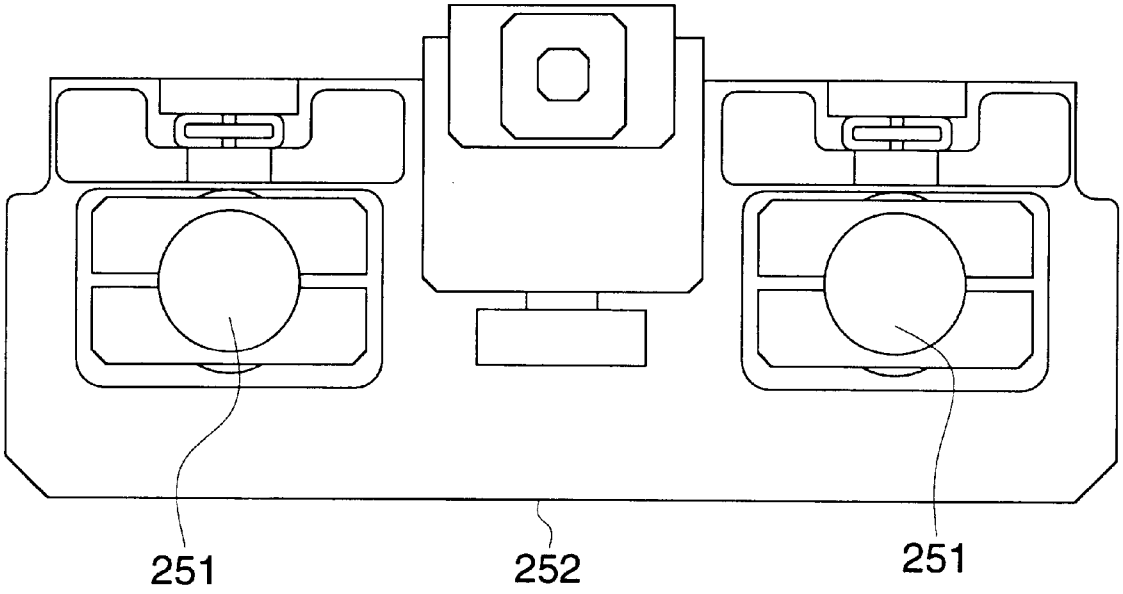
FIG. 10 is a plan view of aforesaid horn unit.

As shown in FIGS. 9 and 10, in horn unit 250, ultrasonic horn 251 is fixed on the both side of retention plate 252, and by intruding retention plate 252 onto rotation shaft 253, ultrasonic wave horn 251 is connected with loading device 254. Horn unit 250 may be provided depending upon the width of the web. In the present embodiment, the width of the web is several hundred mm. Therefore, 5 individual horn units 250 are arranged at prescribed intervals. The number of horn units 250 is not specifically limited. It can be changed in accordance with the width of the web.

The first web and the second web are overlapped on the welding section of the processing stand 270. In addition, aforesaid 5 sets of horn units 250 weld the second web and the first web and creates a splice in a very short time, whereas 10 ultrasonic wave horns 251 located across the width at an equivalent pitch presses the welding portion of processing stand 270 the splicing portions of the first web and the second web to be fixed by fixing device 240 and moves across the width of the web at 20 mm/sec. while one-width amplification at a width of 20–40 $\mu$m, and at a frequency of 20–40 kHz load of 1–8 kg.

If the leading end of the second web and the trailing end of the first web are welded by means of ultrasonic waves, solution splashing occurred due to the difference of coating property which occurred in the case of using conventional silver tape. However, it is necessary to minimize the thickness of the spliced portion between the first web and the second web. Practically, it is necessary to take action not to increase the thickness of the web at the spliced portion of the first web and the second web. In order to solve this problem, the following technology is provided.

The first countermeasure is a modified ultrasonic wave horn which will now be explained.

Figure 11:
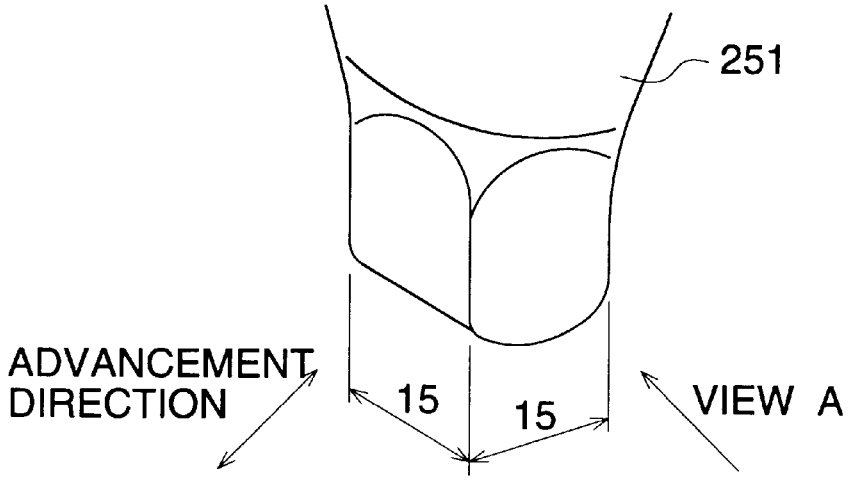
FIGS. 11(*a*) and 11(*b*) are drawings showing the form of end of ultrasonic wave horn of the present embodiment.
Figure 11:
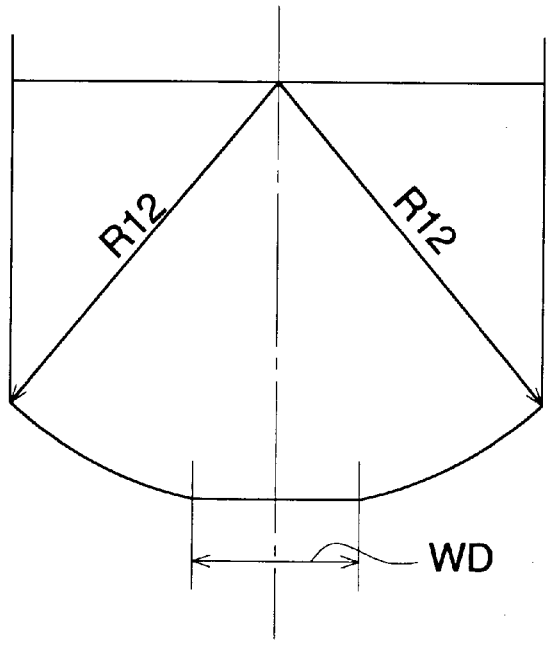

FIGS. 11(*a*) and 11(*b*) are drawings showing a leading end type of ultrasonic wave horn of the present invention. FIG. 11(*a*) is a perspective view showing the leading end of aforesaid ultrasonic wave horn, and FIG. 11(*b*) is the view from arrow A.

In order to prevent gathering excessive heat at the leading portion of the ultrasonic wave horn, it is made of a material having favorable heat transmissivity such as extra super duralmin and titanium, and thereby, it is provided that uneven welding may not occur at the horn contact surface. Heat transmissivity ratio of extra super duralmin is 0.23 Cal/g° C. Heat transmissivity ratio of titanium is 0.12 Cal/g° C. Therefore, it is preferable to use extra super duralmin.

The form of the end of ultrasonic wave horn 251 is, as shown by FIGS. 11(*a*) and (*b*), flat having a 3 mm length.

From both ends of the flat portion (WD), a curve is formed, and thereby there is no dispersion in terms of welding to provide favorable welding portion. If the end of ultrasonic wave horn 251 is curved not providing a flat portion, dispersion may occur in the welding condition of the splicing between the first web and the second web.

In the present embodiment, in order to complete ultrasonic wave welding in a short time, plural ultrasonic wave horns 251 are arranged as described before. Therefore, in the present embodiment, it is necessary to minimize uneven welding of plural ultrasonic wave horns 251. The reason why such necessity occurs is that, if welding conditions are different between when running of ultrasonic horn 251 starts and when running of it stops, the thickness of web varies at the spliced portion. In order to minimize the change of the thickness of aforesaid web, in the present embodiment, running portion of adjoining ultrasonic wave horns 251 are over-lapped.

By providing the above-mentioned constitution, ultrasonic wave splicer 200 of the present embodiment can produce a curving accuracy at the spliced portion where the second web and the first web are welded to be 0.057° or less and the thickness of the spliced portion where the second web and the first web are welded to be 350 $\mu$m or less. Thus, dragging of air at the rear of the spliced portion where the second web and the first web are weldedis greatly reduced.

Figure 17:
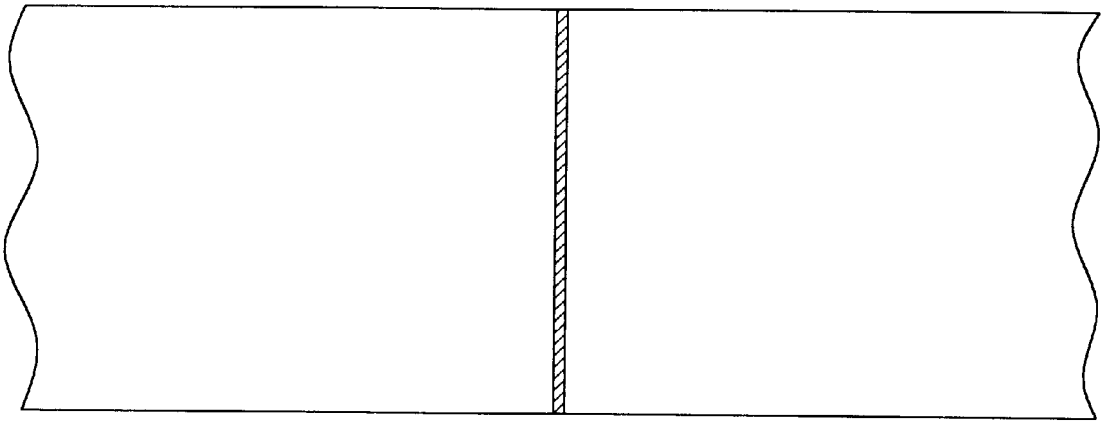
FIGS. 17(*a*) and 17(*b*) are illustrations showing welding condition between the leading end of the second web and the trailer end of the first web by means of a ultrasonic wave welding method.
Figure 17:
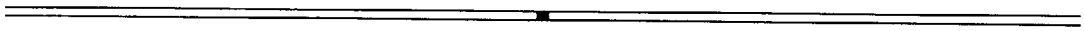
Figure 18:
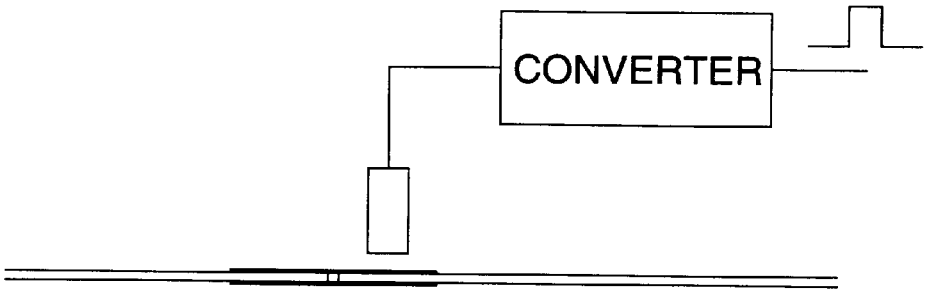
FIG. 18 is an illustrative drawing showing a conventional splice sensing method.
Figure 19:
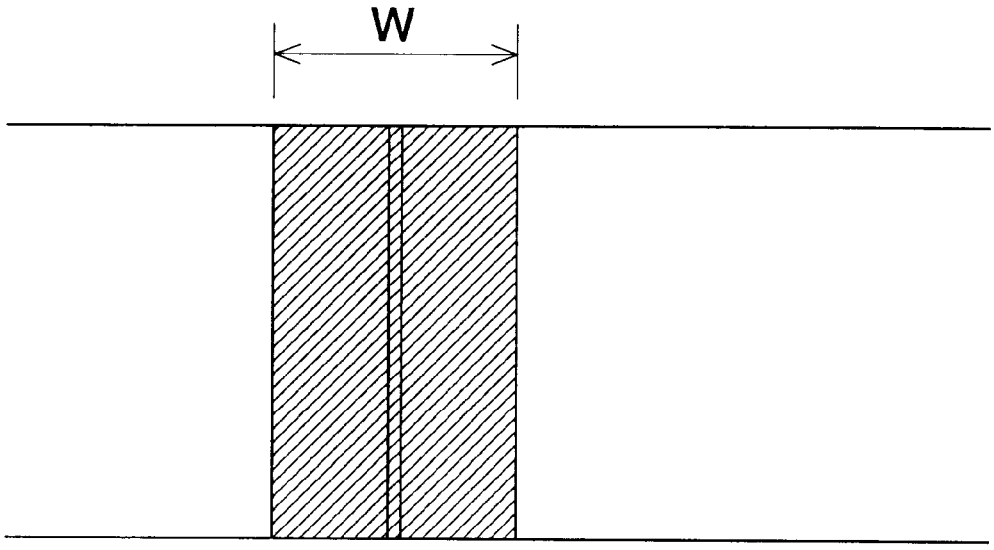
FIG. 19 is an illustration showing a conventional splicing method.

FIG. 17 is a schematic drawing showing the welding state of the leading end of the second web and the trailing end of the first web, utilizing an ultrasonic wave welding method. FIG. 17(*a*) shows a plan view of the welded section, and FIG. 17(*b*) shows a side view of the welded section.

The width of aforesaid welded section by means of the ultrasonic wave welding is about several mm, as described before. Provided that the coating speed (hereinafter, abbreviated as CS) is several hundreds m/min., the welding section passes within several m sec. Therefore, in order to sense it, the processing speed of the sequencer cannot cope with it. Secondly, since the width of the welded section is quite narrow, the amount of reflection from aforesaid welded section is so weak as not to be sensed. Thirdly, since the silver taped welded section of adequately as conventional width is not provided, there is a technical limit for which only a short wavelength light sensor which is not sensitive to the light-sensitive material can be used. Hereinafter, constitutions of the present invention which solves the above-mentioned problems will be explained.

Figure 12:
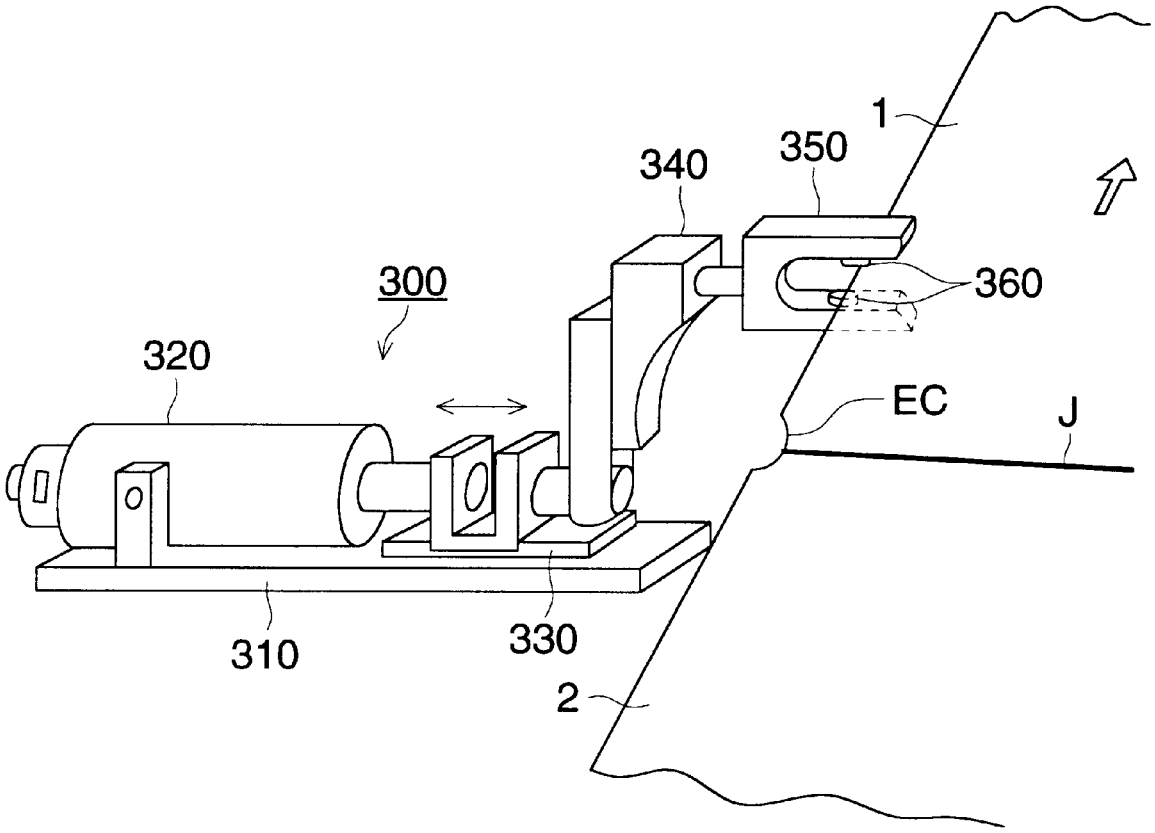
FIG. 12 is a schematic view showing the external appearance of the unit of the present embodiment employing an ultrasonic wave sensor.
Figure 13:
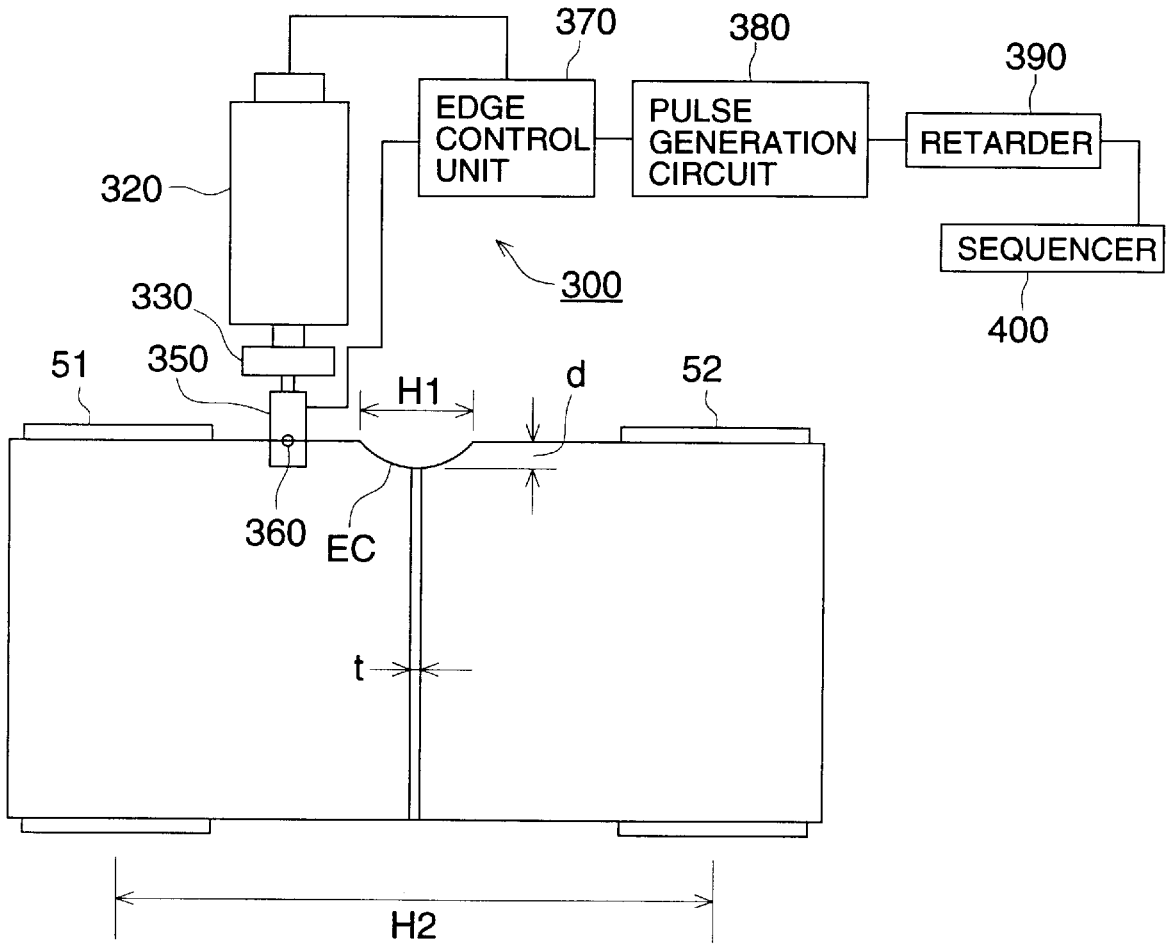
FIG. 13 is a block diagram depicting a splice sensing method of the present embodiment.

FIG. 12 is a schematic view showing the external appearance of a unit of the present embodiment employing an ultrasonic wave sensor. FIG. 13 is a block diagram of a splice sensing method of the present embodiment.

In the present invention, both end of the spliced portion are subjected to edge-cutting by means of an edge-cutting device for providing a sensing target. In aforesaid edge cut device, a punch unit provided with a semi-circular upper blade and a semi-circular lower blade is loaded on the end of a turning arm. By turning with an actuator at both sides of the spliced portion of the web after the above-mentioned splicing processing, the punch unit is so positioned that both sides of the web are sandwiched between the upper blade and the lower blade. When the spliced portion of the web reaches the upper blade and the lower blade, extending edges of the web are cut off. Due to this, both ends of the spliced portion of the web are cut off in a semi-circular form. Aforesaid semi-circular cut-off portion is referred to as edge-cutting EC (see FIG. 13). By providing aforesaid edge cutting EC, the technical problems that the spliced portion cannot be sensed due to minimize reflected amount of light from the welding portion and erroneous sensing due to irregular reflection due to the scratches and creases of the surface of the web, also due to and unevenness of the emulsion can be overcome. In addition, another technical problem that the width of the welding section is so narrow that processing speed of sequencer 400 cannot sense the spliced portion appropriately can also be overcome.

Figure 14:
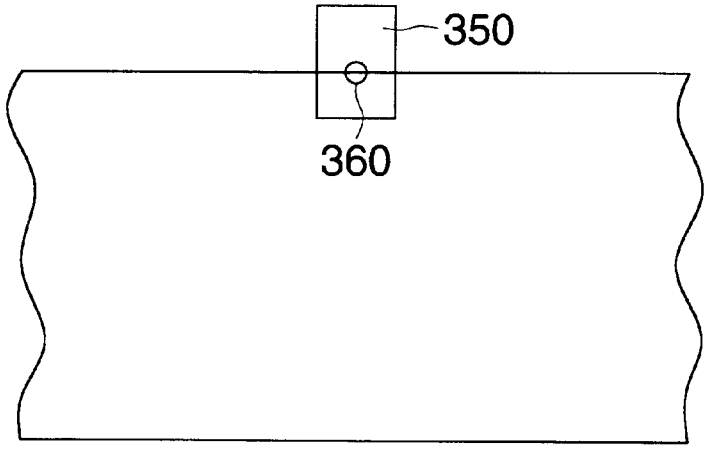
FIGS. 14(*a*) and 14(*b*) are conceptual drawings showing the relationship between the projecting/receiving light angle of the ultrasonic wave sensor.
Figure 14:
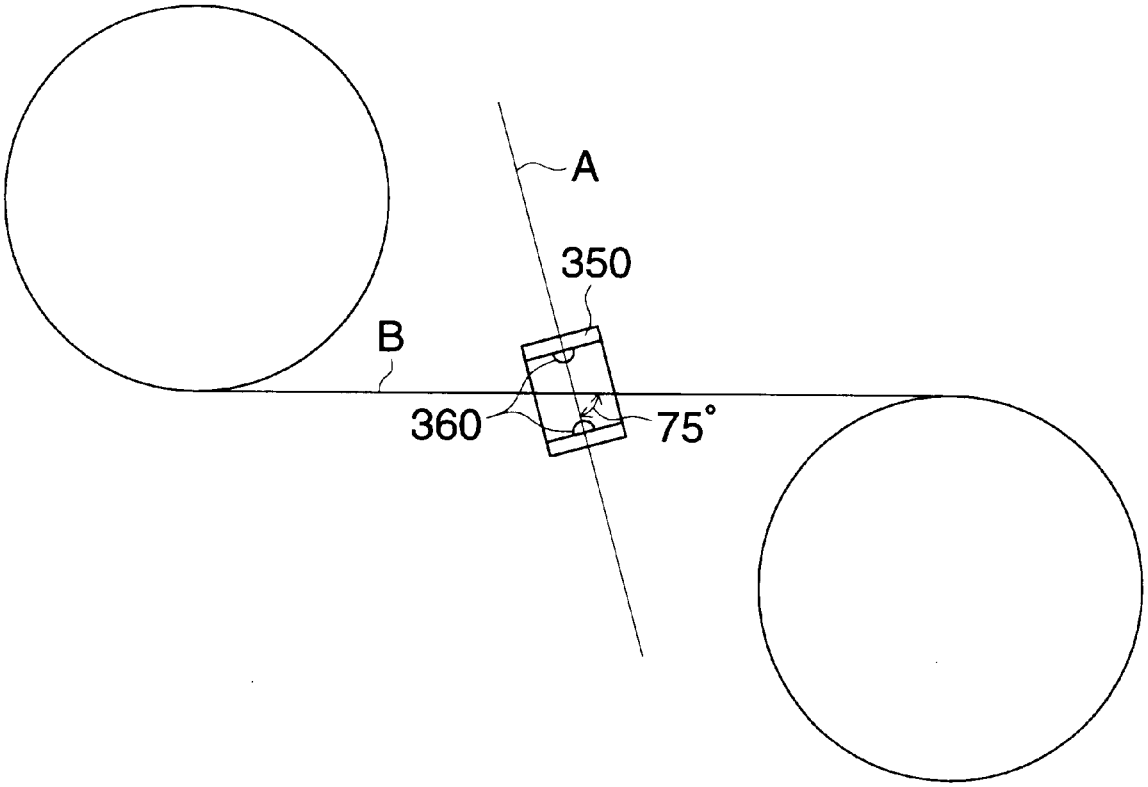

Since the constitution of the splicing sensing units 41 through 45 are identical, splicing sensing unit 300 is typically explained referring to FIGS. 12 through 14.

As shown in FIGS. 12 and 13, splice sensing unit 300 senses the position of spliced portion J between the second web and the first web sensed from edge cut EC for sensing splice pulse. Splice sensing unit 300 is composed of base stand 310, electric actuator 320, miniature LM guide 330, arm section 340, sensor supporting section 350, ultrasonic wave sensor 360 and edge control unit 370, and is provided with an edge control system which controls in such a manner that the edge of the web positions the center of light-receiving element of ultrasonic wave sensor 360 and a splicing pulse generation system, composed of ultrasonic wave sensor 360, edge control unit 370, pulse generation circuit 380 and retarder 390, which generates a splicing pulse by sensing the position of spliced portion J from the edge cut of the web. Hereinafter, constitution of each section will be explained.

Here, referring to FIG. 13, the dimension of edge cut EC will be explained.

Width of the edge cut H1 is some tens mm. Since the response speed of sequencer 400 is some tens msec., the width of edge cut H1 is set to be some tens mm which corresponds to triple of response speed of sequencer 400, considering safety ratio when coating speed is some hundreds m/min.

In order to minimize the scratches and creases of the surface of the webs and irregular reflection due to unevenness of the emulsion, the depth d of edge cut EC is set larger than the diameter of ultrasonic wave sensor 360.

The width t of spliced portion J between the second web and the first web is set some mm. Due to this, solution splashing derived from the difference of coating property and meandering due to insufficient parallelty of web since a conventional silver tape is used can be overcome.

As shown in FIG. 14, edge control unit 370 has a function of edge control which controls the movement of electric actuator 320 and a function which sends a sensing signal from ultrasonic wave sensor 360 to pulse generation circuit 380 in such a manner that the edge of the web positions at the center of light-receiving portion of ultrasonic wave sensor 360 based on sensing signal level from ultrasonic wave sensor 360.

Since electric actuator 320 is fixed on base stand 310 as shown by FIG. 12, when electric actuator 320 is actuated due to the control of edge control unit 370, miniature LM guide 330 is oscillated forward and backward in an arrowed direction on base stand 310. Due to this, arm section 340 and sensor supporting section 350 which fixes the ultrasonic wave sensor is also oscillated forward and backward in an arrow direction so that web edge is controlled to be positioned to the center of the light-receiving element of the ultrasonic wave sensor.

Edge control unit 370 outputs a sensing signal from ultrasonic wave sensor 360 to pulse generation circuit 380. After pulse generation circuit 380 compares outputting level from ultrasonic wave sensor 360 with the standard level, it generates the pulse signal and sends to retarder 390. Retarder 390 retards the pulse signal from pulse generation circuit 380 in order to meet with the speed of the processing speed of sequencer 400. Therefore, sequencer 400 can conduct various control operation by sensing the above-mentioned splicing pulse.

Splicing sensing unit 300 is provided with the above-mentioned constitution, and ultrasonic wave sensor 360 is provided, no fogging occurs in the vicinity of the welding section between the first web and the second web. Moreover, at the both end of welding portion J between the first web and the second web, circular edge cut is formed. In addition, edge was controlled in such a manner that web edge passes the center of ultrasonic wave sensor 360 so that circular edge cut EC senses welding portion J between the first web and the second web. Therefore, there is no possibility to occur sensing impossible condition derived from irregular reflection due to scratches and folding on the surface of web and unevenness of the emulsion. In addition, splicing pulse was inputted into sequencer 400 after retarding it at retarder 390, a problem of unmatched processing speed can also be overcome.

However, another problem that sensing signal from ultrasonic wave sensor 360 hunches derived from fluttering of the web so that erroneous sensing occurs remains.

In the present embodiment, in order to minimize fluttering of the web, the distance between conveyance rollers 51 and 52 in the vicinity of sensor supporting section 350 is shortened as much as possible. For example, if the diameter of conveyance rollers 51 and 52 is some hundreds mm, the distance H2 between conveyance rollers 51 and 52 about double. Due to this constitution, fluttering of the web is minimized.

Only with the location of the above-mentioned conveyance rollers 51 and 52, fluttering of the web cannot be minimized completely. Therefore, response speed of splicing sensing unit 300 is set rather slow.

The present inventor discovered that hunting of the sensing signal due to fluttering of the web can be minimized by adjusting projecting/receiving light angle of ultrasonic wave sensor 360.

FIG. 14 is a conceptual drawing showing location relationship between the projecting/receiving light angle of ultrasonic wave sensor and the web. FIG. 14(*a*) is a plan view, in which it is arranged that the web edge passes the center of the light receiving element of the ultrasonic wave sensor. FIG. 14(*b*) is a side view, in which an angle formed by A which represents a light projection/receiving path of ultrasonic wave sensor 360 and tangent B with the surface of web is arranged to be 75°. By adjusting the projecting/receiving light angle of aforesaid ultrasonic wave sensor 360, hunting of the sensing signal due to fluttering of the web is minimized.

Figure 15:
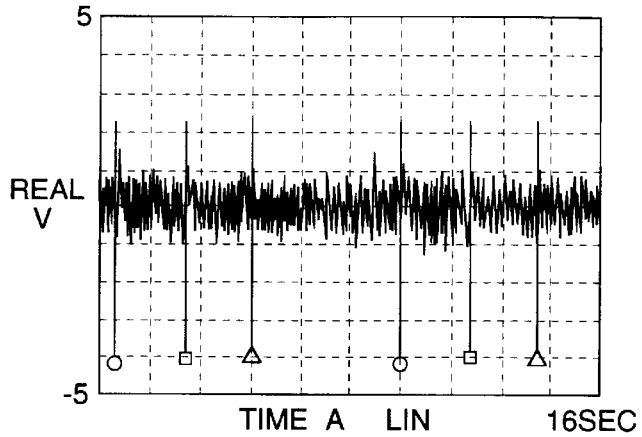
FIGS. 15(*a*) to 15(*c*) are graphs showing an outputting signal from ultrasonic wave sensor when ultrasonic wave oscillated from ultrasonic wave sensor 360 is vertically projected onto the surface of the web.
Figure 15:
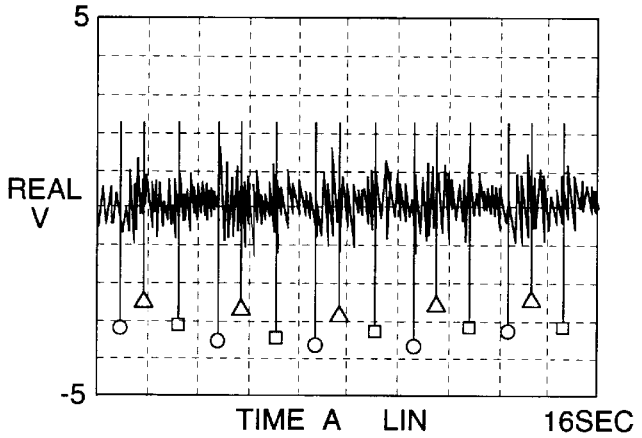
Figure 15:
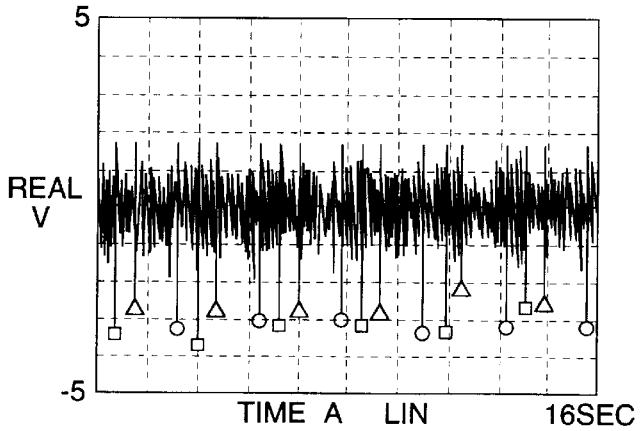
Figure 16:
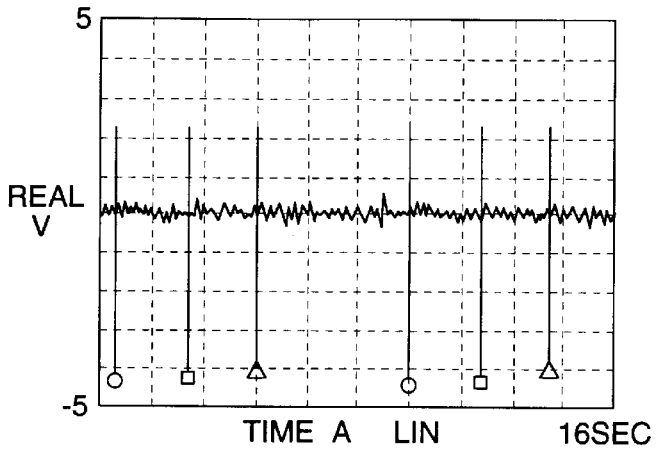
FIGS. 16(*a*) to 16(*c*) are graphs showing an outputting signal from ultrasonic wave sensor when ultrasonic wave oscillated from ultrasonic wave sensor 360 are projected onto the surface of the web at 75.
Figure 16:
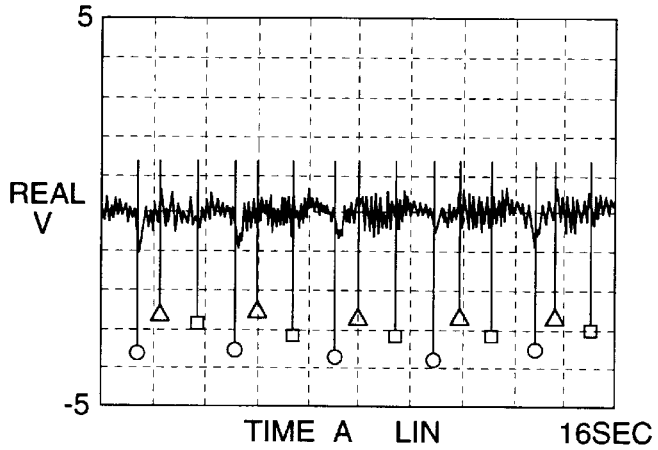
Figure 16:
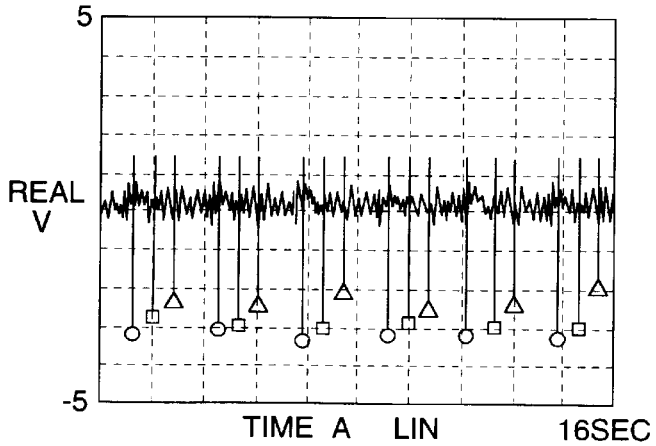

FIGS. 15 and 16 are graphs showing outputting signal from ultrasonic wave sensor.

FIGS. 15(*a*), (*b*) and (*c*) are graphs showing outputting signals from ultrasonic wave sensor 360 when ultrasonic wave oscillated from ultrasonic wave sensor 360 is vertically projected on the surface of the web. FIG. 15(*a*) is a graph when the fluttering of the web is 2 mm and the coating speed is some tens m/min. From this graph, it turns out that the hunting of the sensing signal due to fluttering of the web is ±1.5 V. FIG. 15(*b*) is a graph when the fluttering of the web is 5 mm and the coating speed is some hundreds m/min. From this graph, it turns out that the hunting of the sensing signal due to fluttering of the web is ±1.5 V. FIG. 15(*c*) is a graph when the fluttering of the web is 10 mm and the coating speed is some tens m/min. From this graph, it turns out that the hunting of the sensing signal due to fluttering of the web is ±1.8 V.

From graphs shown in FIGS. 15(*a*), (*b*) and (*c*), when ultrasonic wave oscillated from ultrasonic wave sensor 360 is vertically projected onto the surface of the web, hunting of the sensing outputting from ultrasonic wave sensor 360 is ±1.5 or more, resulting in erroneous sensing.

FIGS. 16(*a*), (*b*) and (*c*) are graphs showing outputting signals from ultrasonic wave sensor 360 when ultrasonic wave oscillated from ultrasonic wave sensor 360 is projected at 75° on the surface of the web. FIG. 16(*a*) is a graph when the fluttering of the web is 2 mm and the coating speed is some tens m/min. From this graph, it turns out that the hunting of the sensing signal due to fluttering of the web is ±1.0 V. FIG. 16(*b*) is a graph when the fluttering of the web is 5 mm and the coating speed is some hundreds m/min. From this graph, it turns out that the hunting of the sensing signal due to fluttering of the web is ±1.0 V. FIG. 16(*c*) is a graph when the fluttering of the web is 10 mm and the coating speed is some tens m/min. From this graph, it turns out that the hunting of the sensing signal due to fluttering of the web is ±1.2 V.

From graphs shown in FIGS. 16(*a*), (*b*) and (*c*), when ultrasonic wave oscillated from ultrasonic wave sensor 360 is projected onto the surface of the web at 75°, hunting of the sensing outputting from ultrasonic wave sensor 360 is less than ±1.5, not resulting in erroneous sensing.

As described above, splicing sensing unit 300 in the present embodiment is provided with the above-mentioned constitutions. Therefore, unmatching of the processing speed by sequencer 400 and erroneous sensing due to insufficient reflection amount from welding section J and irregular reflection can be minimized. In addition, hunting from the sensing signal can be minimized. Therefore, welding section J between the second web and the first web can correctly be sensed.

Accordingly, the coating and drying device of the present embodiment are provided with the above-mentioned constitution. It is possible to minimize solution splashing derived from the difference of coating property of web and meandering of the web due to insufficient parallelty can also be minimized. Therefore, product loss derived from uneven coating and uneven undrying can be minimized.

According to an invention described in Item 1, by providing the above-mentioned constitution, a ultrasonic wave welding device wherein a cutting surface formed at the leading end of the second web and the trailing end of the first web and the amount of lapping the first web and the second web are made uniform and the form of splicing the webs can be made smooth while keeping the welding load at a constant level.

According to an invention described in Item 2, a coating and drying device which can minimize product loss derived from uneven coating and uneven undrying, since solution splashing derived from the coating property such as a web and meandering of the web due to insufficient parallelty can be minimized due to the above-mentioned constitution.

According to an invention described in Item 3, a splicing sensing device which can senses the position of the welding section appropriately between the second web and the first web, since erroneous sensing due to unmatching the processing speed of the control section, insufficient reflection amount and irregular reflection and, in addition, hunting from the sensing signal can be inhibited, due to providing with the above-mentioned constitution.

What is claimed is:

1. An apparatus for splicing a trailing edge of a first web currently used for a web product with a leading edge of a second web to be used after the first web, comprising:

a fixing device for superimposing the second web on or beneath the first web and for fixing the superimposed condition of the first and second webs;

a cutting device for cutting the first and second web simultaneously on the superimposed condition so as to form a trailing edge of the first web and a leading edge of the second web;

means for overlapping the leading edge of the second web on or beneath the trailing edge of the first web so as to form a overlapped section with a predetermined overlapped width; and a ultrasonic welder for welding the overlapped section so as to form a joint section at which the trailing edge of the first web is spliced with the leading edge of the second web.

2. The apparatus of claim 1, wherein the fixing device comprises a first clamping device for clamping both sides of the first web, a second clamping device for clamping both sides of the second web, and a positioning device for detecting positions of the first and second webs and for controlling the first an second clamping devices so as to superimpose the second web on or beneath the first web.

3. The apparatus of claim 2, wherein the cutting device comprises a cutting base and a cutter, wherein the fixing device fix the first and second webs on the superimposed condition on the cutter base.

4. The apparatus of claim 1, wherein the overlapping means comprises a first suction box on which the first web is attracted by vacuum, a second suction box on which the first web is attracted by vacuum, a overlapping base on which the trailing edge of the first web and the leading edge of the second web are overlapped, and a pushing device for pushing up the trailing edge of the first web so that the trailing edge of the first web is overlapped on the leading edge of the second web.

5. The apparatus of claim 1, wherein the ultrasonic welder comprises a plurality of horn unit arranged along the width of the web.

6. The apparatus of claim 5, wherein the horn unit comprises a ultrasonic horn made of one of duralmin and titanium.

7. The apparatus of claim 6, wherein the ultrasonic horn is made of duralmin.

8. The apparatus of claim 6, wherein the horn unit comprises a ultrasonic horn whose head is curved in a sectional view and the tip end of the curved head is shaped so as to form a flat surface.

9. The apparatus of claim 6, wherein a length of the overlapped section is several mill-meters, and a length of the flat surface is 3 mm.

10. The apparatus of claim 6, wherein the ultrasonic horn vibrates with an oscillation frequency of 20 to 40 KHz and an oscillation single-side amplitude of 20 to 40 $\mu$m.

11. The apparatus of claim 1, further comprising:

an edge cutting device for cutting an edge of the joint section on the web so as to form a cut-out portion and a detector for detecting the cut-out portion so that the joint section is detected.

12. The apparatus of claim 11, wherein the detector comprises a ultrasonic sensor to detect the position of the edge, an edge control section to control the position of the edge, a pulse generating device to generate a pulse representing the position of the edge on the basis of the detection by the ultrasonic sensor.

13. The apparatus of claim 12, wherein the detector comprises a delay device to delay the pulse.

14. The apparatus of claim 12, wherein the ultrasonic sensor comprises a transmitter to emit ultrasonic wave in a predetermined transmitting direction and a receiver to receive the ultrasonic wave, and wherein the transmitting direction crosses a conveying direction of the web with a predetermined angle.

* * * * *